US010059578B2

(12) United States Patent
Muszinski

(10) Patent No.: US 10,059,578 B2
(45) Date of Patent: Aug. 28, 2018

(54) METHOD FOR CONTROLLING A FILLING SYSTEM, AND THE FILLING SYSTEM

(71) Applicant: KHS GmbH, Dortmund (DE)

(72) Inventor: Olaf Muszinski, Mainz (DE)

(73) Assignee: KHS GmbH, Dortmund (DE)

( * ) Notice: Subject to any disclaimer, the term of this patent is extended or adjusted under 35 U.S.C. 154(b) by 712 days.

(21) Appl. No.: 14/349,770

(22) PCT Filed: Sep. 28, 2012

(86) PCT No.: PCT/EP2012/004074

§ 371 (c)(1),
(2) Date: Apr. 4, 2014

(87) PCT Pub. No.: WO2013/050124

PCT Pub. Date: Apr. 11, 2013

(65) Prior Publication Data

US 2014/0238531 A1 Aug. 28, 2014

(30) Foreign Application Priority Data

Oct. 4, 2011 (DE) ..... 10 2011 114 690

(51) Int. Cl.

| | |
|---|---|
| ***B65B 31/00*** | (2006.01) |
| ***B67C 3/28*** | (2006.01) |
| ***B67C 3/00*** | (2006.01) |
| ***B67C 3/02*** | (2006.01) |
| ***B67C 3/22*** | (2006.01) |

(52) U.S. Cl.

CPC ..... *B67C 3/28* (2013.01); *B67C 3/007* (2013.01); *B67C 3/02* (2013.01); *B67C 3/22* (2013.01)

(58) Field of Classification Search

CPC .. B67C 3/28; B67C 3/007; B67C 3/02; B67C 3/22

See application file for complete search history.

(56) References Cited

U.S. PATENT DOCUMENTS

2010/0071802 A1 3/2010 Clusserath et al.

FOREIGN PATENT DOCUMENTS

| | | |
|---|---|---|
| DE | 20105716 | 5/2002 |
| DE | 202005004949 | 6/2005 |
| DE | 102008031049 | 12/2009 |
| EP | 1 559 674 | 8/2005 |
| JP | 2002 337988 | 11/2002 |
| WO | 2009/068144 | 6/2009 |

*Primary Examiner* — Jason K Niesz

(74) *Attorney, Agent, or Firm* — Occhiuti & Rohlicek LLP

(57) ABSTRACT

A method for filling containers with a fill of liquid material and solids using a container-filling machine having a tank, a filling element, a processing unit, a bypass pipe and pump, and an overflow pipe. The tank holds the fill. The filling element controls delivery of fill from the tank into the container. The processing unit provides the fill to the tank. The by-pass pipe connects to the filling element. The pump returns a residual quantity from the tank to the processing unit. The residual quantity is a quantity of one of the fill and a by-pass volume flow from the filling element. The overflow pipe returns an unneeded quantity of fill to the processing unit. The method includes, using a by-pass pump embodied as a displacement pump, actively drawing the residual quantity from the filling element or tank.

19 Claims, 1 Drawing Sheet

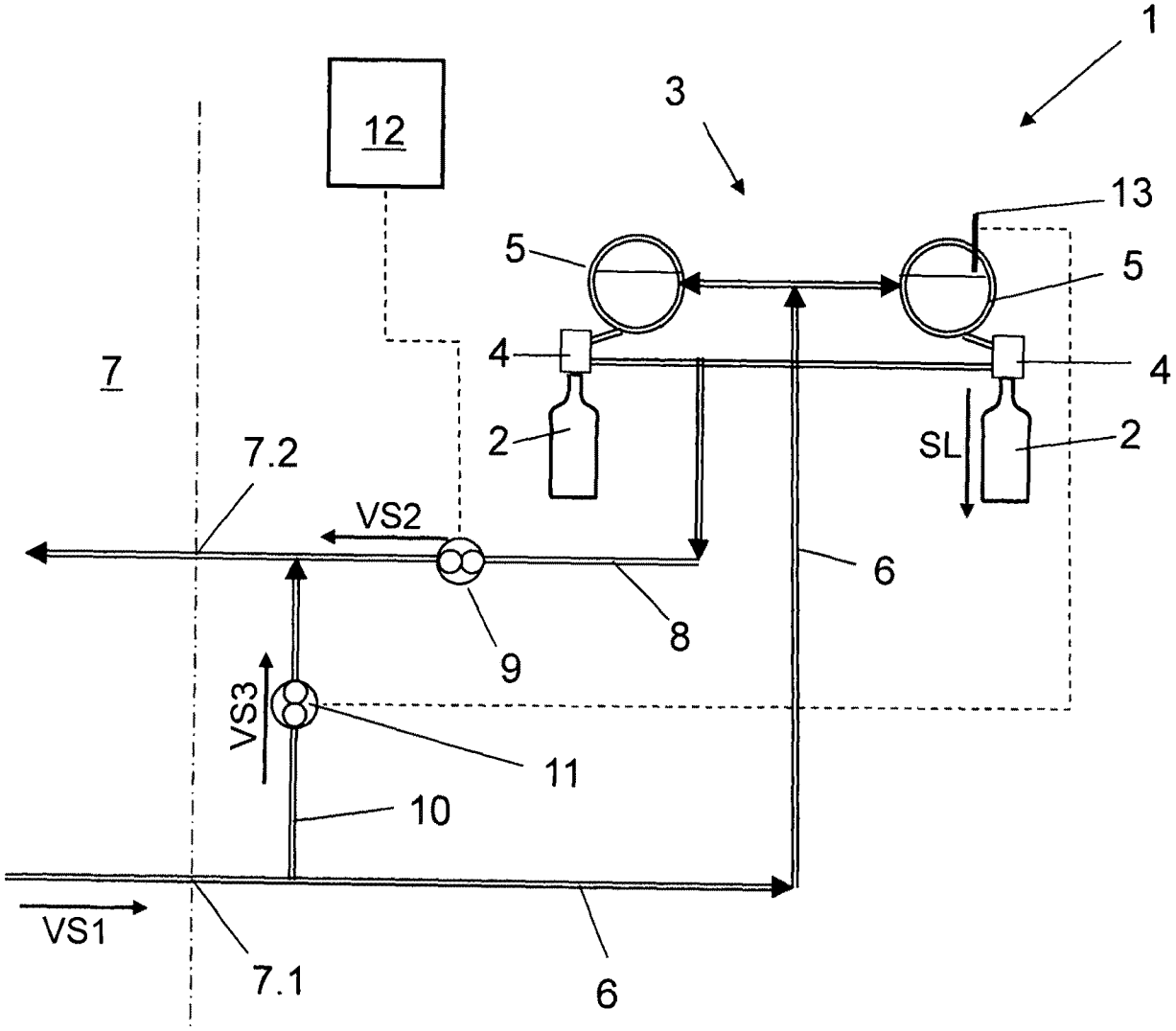
1
13
5
4
2
SL
6
3
8
5
4
2
9
12
VS2
11
10
VS3
7.2
7.1
7
VS1

METHOD FOR CONTROLLING A FILLING SYSTEM, AND THE FILLING SYSTEM

RELATED APPLICATION

This application is the national stage entry of PCT/EP2012/004074, filed Sep. 28, 2012, which claims the benefit of the Oct. 4, 2011 priority date of German application DE 102011114690.7, the contents of which are herein incorporated by reference.

FIELD OF INVENTION

The invention concerns a filling system and a method for controlling the filling system for filling containers with liquid material that contains solids.

BACKGROUND

Certain products, including drinks, contain, in a liquid component thereof, solid constituents. Examples of such solid constituents include product pieces, cells, and fibers.

When filling these products, it is important for the solid constituents to reach the particular container as intact as possible, i.e. as undamaged as possible. This will meet consumers' quality expectations and help to avoid complaints.

Damage to the solid constituents arises from thermal or mechanical causes. Thermal damages can occur as a result of overly long heating of the filling material. Mechanical damage can arise from shearing forces from product-damaging fittings in the flow paths for filling material in a filling system.

Examples of product-damaging fittings include adjustment and control valves, overflow valves, and, to a lesser degree, pumps used to transport the filling material. When operated at high speed, displacement pumps can cause product damage. However, displacement pumps are less likely to cause damage than dynamic pumps. For this reason, it is common in the beverage industry to transport products containing solid constituents using displacement pumps. Suitable pumps that have been used include reciprocating pumps, rotary piston pumps, and diaphragm pumps.

For hot filling or hot aseptic filling of products, including those with solid constituents, it is know to use filling systems in which a processing unit supplies the hot filling material or product and feeds it to the filling tank of a container-filling machine at a volume flow rate that is greater than the current filling or pour rate of the container-filling machine. Part of the supplied filling material supplied is fed through the container-filling machine and its filling elements and returned to the processing unit by a by-pass pipe. This part is referred to as "by-pass volume flow."

A bypass pump adjusts the by-pass volume flow so as to keep the container-filling machine at the required temperature solely by the by-pass volume flow of the filling material. The control or adjustment of the by-pass pump or its delivery rate occurs depending on a temperature sensor provided on the container filling machine. However, higher delivery rates or high pump speeds are difficult to avoid.

Depending on the operating status of the container-filling machine used for hot filling, different by-pass volume flows are required. For example, the required volume flow for heating-up of the container filling machine during a production preparation phase may be different from that required during the operation of the container-filling machine, or that required during a machine stoppage due to a production interruption. These different by-pass quantities or by-pass volume flows are often expressed as a volume percentage of a nominal pour rate of the container filling machine. In a typical installation, the by-pass volume flow during the starting-up and heating-up of the filling machine is around 0% of the nominal pour rate, during the normal problem-free operation, it is around 5 to 10% of the nominal pour rate, and during a product interruption, it is between 5% and 10% of the nominal pour rate. This variability in bypass flow rate arises from control and/or adjustment of the by-pass pump.

Moreover, in filling systems, it is also known that the volume flow of the filling material supplied by the processing unit can largely be regarded as constant due to the thermal inertia of the processing unit. Thus, depending on the current operating status of the filling machine, a certain quantity of the filling material supplied by the processing unit is to be diverted, for example in the event of an emergency halt of the filling machine, 100% of the volume flow provided by the processing unit.

Thus, on the one hand, account is taken of the fact that the heat exchangers usually used to heat the filling material in the processing units only work effectively if a minimum volume flow of the filling material flows through them, and that the processing unit is generally not able to adapt the filling material quantity supplied by it or the volume flow supplied by it without delay to changes in the pour rate of the container-filling machine. In known filling systems, the overflow pipe made formed by the overflow valve is thus used for this adaptation on the one hand. To hold the level of the filling material constant in a filling tank of the container-filling machine, in known filling systems, a control valve is needed. The control valve is provided in the primary pipe connecting the processing unit to the filling tank of the container-filling machine.

A disadvantage in known filling systems arises from the high stress on the solid constituents contained in the filling material due to product-damaging fittings. This arises as a result of the adjustment or control valve needed in the primary pipe, the overflow valve provided in the overflow pipe, and the by-pass pump driven by the relatively high delivery rate. Another known disadvantage of such filling systems is the high consumption of energy consumption that arises when a substantial volume flows through a substantial pressure difference.

SUMMARY

The invention provides a method with which, with high operating reliability, a particularly product-kind filling of containers is achieved even with a filling material containing solid constituents.

Particular advantages of the invention include the avoidance of product-damaging fittings in the primary connection or pipe between the processing unit and the filling tank of the container-filling machine, including a product-damaging overflow valve in an overflow pipe. With the invention, furthermore a clear saving of filling material is achieved as there is no need to separate out filling material with damaged solids.

The by-pass pump in the by-pass pipe is, for example, adjusted such that the volume flow supplied by the by-pass pipe and the by-pass pump during the normal problem-free operation is only around 5% of a base value, for example the nominal pour rate of the container-filling machine, so that, due to the reduced delivery rate of this pump alone, a product-kind return of the filling material is achieved. In this embodiment, therefore, the by-pass pump is thus operated during normal operation at a constant speed and thus at a constant delivery rate.

In the filling system according to the invention, the control of the by-pass pump and/or an overflow pump arranged in an overflow pipe occurs preferably by using frequency converters that enable an infinitely variable control or adjustment of the pump delivery rate and thus the corresponding volume flows. Influencing variables or parameters for the control and/or adjustment include, for example, the current pour rate of the container-filling machine, the nominal pour rate of the container-filling machine, the type, size, and shape of the containers, the current product output of the processing unit or the current volume flow of the filling material achieved by the processing unit. Furthermore, for the control and/or adjustment, a prognosis can be taken into account about the future output or pour rate of the container-filling machine to be expected and/or the output of a container blowing machine upstream of the container-filling machine.

The volume flow of the filling material supplied by the processing unit is constant, for example, in normal operation and is set such that, taking account the current pour rate of the container-filling machine, by means of the by-pass pipe the volume flow of 5% of the base value, e.g. of the nominal pour rate, and by means of the overflow pipe or by means of the overflow pump there, a volume flow of between around 5% to 105% of the base value is transported.

In one aspect, the invention features a method for controlling a filling system and a container filling machine for filling containers with a filling material that comprises a liquid material and solids, wherein the container filling machine comprises a filling tank, a filling element, a processing unit, a by-pass pipe, a by-pass pump, and an overflow pipe, wherein the filling tank holds the filling material, wherein the filling element controls delivery of the filling material from the filling tank into the container, wherein the processing unit provides the filling material to the filling tank, wherein the by-pass pipe connects to the filling element, wherein the by-pass pump returns a residual quantity from the filling tank to the processing unit, wherein the residual quantity is a quantity of one of the filling material and a by-pass volume flow from the filling element, and wherein the overflow pipe returns an unneeded quantity of filling material to the processing unit, the method comprising, using a by-pass pump embodied as a displacement pump, actively drawing the residual quantity from one of the filling element and the filling tank.

Some practices of the invention include using a by-pass pump comprises operating the by-pass pump at a constant delivery rate at least during normal filling operation for causing a constant volume flow in the by-pass pipe.

Other practices of the invention include adjusting a level of the filling material in the filling tank by changing a volume flow in the overflow pipe.

Additional practices of the invention also include adjusting a level of the filling material in the filling tank by changing a delivery rate of an overflow pump in the overflow pipe.

In yet other practices, the method further includes aseptically filling a container with the filling material.

Other practices include causing the processing unit to supply a volume flow rate of filling material that is greater than a sum of a current pour rate of the container-filling machine and a by-pass volume flow rate returned by the by-pass pipe. Among these are practices that include causing a volume flow rate returned by the overflow pipe to be equal to a difference between the volume flow rate supplied by the processing unit and a total of the current pour rate and the by-pass volume flow rate.

Additional practices of the invention include those that further comprise causing the processing unit to supply a volume flow rate that is approximately 110% of a base value, and causing the bypass flow rate to be approximately 5% of the base value, wherein the base value is a nominal pour rate of the container filling machine.

In another aspect, the invention features an apparatus comprising a filling system comprising a container filling machine, the container filling machine comprising an annular tank, a bypass pipe, a bypass pump, filling elements, an overflow pipe, a primary pipe, a processing unit, and a rotating structure, wherein the tank is partially filled with filling material, wherein the tank is connected to the filling elements, wherein the bypass pipe is connected to one of the filling element and the tank, wherein the bypass pump returns one of a partial filling material and a bypass volume flow to the processing unit, wherein the filling elements are disposed on the rotating structure, wherein the filling material comprises a suspension of solid constituents in a liquid, wherein the overflow pipe returns a quantity of filling material back to the processing unit, wherein the primary pipe supplies the filling material to the tank from the processing unit, wherein the primary pipe is free of product-damaging fittings, and wherein the processing unit is connected to the tank, wherein the quantity of filling material that is returned back to the processing unit is a quantity that is unnecessary for filling or topping up the tank, and wherein the rotating structure is selected from the group consisting of a rotor and a rotating transport element.

Some embodiments include an overflow pump that is disposed in the overflow pipe. This overflow pump can be, for example, a displacement pump, such as a reciprocating pump, a rotary piston pump, or a diaphragm pump.

In other embodiments, the bypass pump is a displacement pump. The bypass pump can be, for example, a reciprocating pump, a rotary piston pump, or a diaphragm pump.

Additional embodiments include a control circuit for controlling a delivery rate of the overflow pump in the overflow pipe so as to maintain a level of filling material in the tank. Among these embodiments are those in which the control circuit is configured to control the delivery rate at least in part based on a current or expected pour rate of the filling machine. Also among these embodiments are those in which the is configured to control the delivery rate at least in part based on a current or expected volume flow provided by the processing unit.

As used herein, "product-kind filling" means the filling of products or filling materials containing solid constituents in such a way that these solid constituents reach the particular container as intact as possible, i.e. with a minimum of mechanical damaged.

Product-kind filling requires that, in product-delivery pipes of the filling system, i.e. at least in the primary pipe that connects the tank of the filling machine to the processing unit supplying the filling material, the fittings that damage solid constituents in the filling material be avoided as far as possible. Fittings of this kind include overflow valves, and adjustment or control valves.

As used herein, "pour rate" means the filling performance, measured for example in liters, of the container-filling machine per unit of time, for example per hour. Accordingly, as used herein, "nominal pour rate" means the filling performance, measured, for example, in liters/hour, of the container-filling machine in normal operation. This nominal pour rate can, for example, be 100,000 liters per hour when filling containers that have a container volume of 0.5 liters.

As used herein, "containers" include cans, bottles, tubes, pouches, in each case made of metal, glass and/or plastic, as well as other packaging means that are suitable for filling with liquid or viscous products.

As used herein, "free-jet filling" means a process in which the liquid filling material flows into the container to be filled in a free filling jet, and in which the container mouth or opening of the container does not lie against the filling element, but is at a distance from the filling element or from a filling material outlet there.

As used herein, "pressure filling" means a filling method in which the container to be filled lies in a sealed position against the filling element and generally is pre-tensioned before the actual filling phase, i.e. before the liquid valve is opened, by using at least one controlled gas path formed in the filling element with a pressurization gas under pressure (inert gas or CO2 gas), that then, during the filling, is increasingly forced out of the container interior by filling material flowing into the container as a return gas, this being likewise using at least one controlled gas path formed in the filling element. Further treatment phases can precede this pre-tensioning phase. These can include, for example, the evacuation and/or the purging of the inside of the container with an inert gas, e.g. CO2 gas etc. This can be carried out using the gas paths formed in the filling element.

As used herein, "pressure-free filling" means a filling method generally in which the container to be filled lies with its container mouth in a sealed position against the filling element and in which the inside of the container is generally pre-treated before the actual filling phase, i.e. before the liquid valve is opened, by using controlled gas paths formed in the filling element, for example evacuated and/or purged with an inert gas, for example CO2 gas, whereby then, during the filling, the gas increasingly forced out by the filling material flowing into the container is removed from the inside of the container as a return gas by means of at least one controlled gas path formed in the filling element.

As used herein, the expressions "substantially" and "approximately" mean deviations from exact values by +/−10%, and preferably by +/−5%, and/or deviations in the form of changes not significant for functioning.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

The invention, and a preferred embodiment thereof, can be understood from the following detailed description and the accompanying FIGURE, which shows a filling system for the product-kind filling of a filling material containing solid constituents into bottles or similar containers.

DETAILED DESCRIPTION

A filling system 1 shown in the figure serves for the hot filling of a liquid filling material with solid constituents into containers 2, i.e. for the filling of the containers 2 with the heated filling material.

The filling system 1 comprises a container-filling machine 3 of a rotary design, of which schematically two filling elements 4 are shown. The filling machine 3 is provided with a plurality of similar filling elements 4 on the circumference of a rotor that can be driven around a vertical machine axis. Each filling element 4 forms one filling position for filling the containers 2. A common filling tank or annular tank 5 provides filling material to all the filling elements 4 or filling positions.

It is clear that filling systems according to the invention can also have container-filling machines of a linear design.

The filling material, which is heated to a specified temperature, is fed to the annular tank 5 by a primary pipe 6 from the outlet 7.1 of a processing unit 7. As a result, thee annular tank 5 is partially filled, at least during the filling operation, with liquid filling material that defines a lower liquid space. The height or level of the filling material in the annular tank 5 is kept constant.

Each of the filling elements 4 is connected to a filling material channel. This filling material channel, which is formed in the filling element 4, has a liquid valve that connects to the liquid space of the annular tank 5.

A separate outlet connects a filling element 4 into a by-pass pipe 8 having a by-pass pump 9 arranged thereon. Preferably, the by-pass pump 9 is a displacement pump that returns a residual quantity of filling material or a by-pass volume flow from the container-filling machine 3 or the filling elements 4 to the central processing unit 7. A rework container at the central processing unit 7 collects the returned filling material. As a result, the filling elements 4 are heated by hot filling material that flows through the filling elements 4 even if production stops and and the liquid valve closes.

The filling system 1 also comprises an overflow pipe 10 having an overflow pump 11 arranged therein. Preferably, the overflow pump 11 is a displacement pump. The overflow pipe 10 connects the primary pipe 6 to the by-pass pipe 8 in the direction of flow of the filling material after the by-pass pump 9, this being for a controlled filling material flow directly between the outlet 7.1 and the inlet 7.2 of the processing unit.

During normal filling operation, the filling system 1 is operated so that the processing unit 7 supplies, at its outlet 7.1, a first volume flow rate VS1 (filling material quantity per unit of time) that is constant or substantially constant and that is also greater than the current pour rate of the container-filling machine 3. In the embodiment shown, the first volume flow rate VS1 is 110% of the nominal pour rate of the container-filling machine 3.

A process computer 12 controls the by-pass pump 9, and in particular, the delivery rate of the bypass pump 9, such that in normal operation, i.e. in problem-free uninterrupted operation, a second volume flow rate VS2 of the filling material returned to the processing unit 7 by the by-pass pump 9, arises. In the illustrated embodiment, this second volume flow is constant or substantially constant and corresponds to, for example, 5% of the base value, e.g. the nominal pour rate of the container-filling machine 3.

Depending on the signal of a fill-level sensor 13 provided in the annular tank 5, the overflow pump 11*b*, or its output, is controlled or adjusted so that a third volume flow rate VS3 in the overflow pipe 10 equals the difference between the first volume flow rate VS1 and the total of the current pour rate SL of the filling machine 3 and the second volume flow rate VS2, namely

VS3=(VS1−(SL+VS2)).

It is to be taken into account here that the first volume flow rate VS1 cannot be changed quickly. This is because the processing unit 7 can react only with a relatively large time delay to changes in the output of the container-filling machine 3, i.e. in particular short-term changes to the pour rate of the container-filling machine 3. Such short-term changes can occur in the event of operating problems in the container-filling machine 3 or a system including the container-filling machine 3. These have to be compensated for in the filling system 1 outside the processing unit 7.

Thus, in the illustrated embodiment, the third volume flow rate VS3 is adjusted in the overflow pipe 10 to be in a range of 5%-105% of the base value, e.g. of the nominal pour rate of the container-filling machine 3, this being in a form whereby, at least in normal operation of the container-filling machine 3 and/or the filling system 1 by means of the overflow pipe 10 around 5% of the base value, e.g. the nominal pour rate, and with an interruption in the filling operation, i.e. when the current pour rate of the container-filling machine 3 is zero, 105% of the base value, e.g. the nominal pour rate, is returned.

For the quality of the filling process, it is essential that the level of the filling material in the partially filled annular tank 5 be kept constant or substantially constant as containers are filled. The accuracy of the filling quantity introduced into the containers 2 or the accuracy of the filling level is determined primarily by the geodesic height of the level of the filling material in the annular tank.

In the filling system 1 according to the invention, adjustment of this level does not occur by a control or adjustment valve provided in the primary pipe 6. Instead, it occurs indirectly by changing the third volume flow rate VS3 in the overflow pipe 10. As a result, the main flow path of the filling material, i.e. the primary pipe 6, remains free of product-damaging fittings.

The by-pass pump 9 in the by-pass pipe 8 and the overflow pump 11 in the overflow pipe 10 are preferably displacement pumps. Examples of such displacement pumps include reciprocating pumps, rotary piston pumps, and diaphragm pumps. By using the by-pass pump 9, it is possible, without any problem, to keep the second volume flow rate VS2 drawn from the filling elements 4 or from the annular tank 5 constant and to control and/or to adjust the third volume flow rate VS3 exactly. This is because the delivery volume of a displacement pump, and thus also the second and third volume flow rates VS2 or VS3, is proportional to the pump speed. This results in improved control or adjustment behavior of a control circuit to keep the second volume flow rate VS2 constant or to control and/or to adjust the third volume flow rate VS3.

Moreover, the ability to keep the filling material level constant in the annular tank 5, which is essential for the quality of the filling process, is substantially improved. In addition, low pump speed reduces mechanical stressing of the solids contained in the filling material.

As a result of the illustrated configuration, the by-pass pump 9 and the overflow pump 11 cause minimal damage to solids in the filling material. This is because during the normal problem-free filling operation, i.e. during those periods in which the container-filling machine 3 has its maximum pour rate or nominal pour rate, the by-pass pipe 8 and also the overflow pipe 10 carry only very small quantities of filling material.

The illustrated filling system 1 thus considerably reduces damage to solids in the filling material introduced into the containers 2 and thus reduces the likelihood of customer complaints. This advantage arises because the main flow path of the filling material, i.e. the primary pipe 6, is free of product-damaging fittings.

A further substantial advantage of the filling system 1 arises from the fact that, due to the use of the by-pass pump 9 and overflow pump 11 in the by-pass pipe 8 and in the overflow pipe 10 respectively, the two pipes can be brought together outside the processing unit 7, i.e. before the inlet 7.2. As a result, the processing unit 7 can be made much simpler. This simplicity arises from the avoidance of additional flow paths inside the processing unit, and also from the avoidance of the product-damaging overflow valve that is present in known filling systems.

The invention has been described above using an example of an embodiment. It is clear that numerous modifications and variations are possible without thereby departing from the inventive idea underlying the invention.

Thus, above it is assumed that the filling system 1 is used for the hot or hot aseptic filling of the filling material into the containers 2. Naturally, the filling system 1 is also suitable for the aseptic filling of products or filling materials containing solids at normal or ambient temperature or in a cooled state. Moreover, the filling system 1 is suitable for different filling methods, for example for free-jet filling, pressure filling, pressure-free filling etc.

Above, it was also assumed that the second volume flow rate VS2 is drawn from the filling elements 4 or from the annular tank 5 by the by-pass pump 9. Embodiments are also possible in which the by-pass pipe 8 is connected directly to the filling tank 5.

REFERENCE SYMBOL LIST

1 Cooling system
2 Container
3 Container filling machine
4 Filling element
5 Annular tank
6 Primary pipe
7 Processing unit for supplying the filling material
8 By-pass pipe
9 Pump (by-pass pump)
10 Overflow pipe
11 Pump (overflow pump)
12 Process computer
13 Filling level sensor
VS1 Volume flow supplied by the processing unit 7
VS2 Volume flow in the by-pass pipe 8
VS3 Volume flow in the overflow pipe 10
SL Pour rate

The invention claimed is:

1. A process for controlling an apparatus comprising a filling system, wherein said filling system comprises a container-filling machine, wherein said container-filling machine comprises an annular tank, a bypass pipe, a bypass pump, a filling element, an overflow pipe, a processing unit, and a control circuit, wherein said annular tank is partially filled with said filling material and connected to said filling element, wherein said bypass pipe is connected to one of said filling element and said annular tank to return a residual quantity from said annular tank to said processing unit, said residual quantity being a quantity of one of said filling material and a by-pass volume flow from said filling element, wherein said overflow pipe returns an unneeded quantity of filling material to said processing unit, said quantity of filling material that is returned back to said processing unit being a quantity that is unnecessary for filling or topping up said annular tank, wherein said processing unit is connected to said annular tank to provide said filling material to said annular tank, and wherein said control circuit is configured for controlling a delivery rate of said overflow pump in said overflow pipe so as to maintain a level of filling material in said annular tank, said process comprising, using a by-pass pump embodied as a displacement pump, actively drawing said residual quantity from one of said filling element and said tank, and using said control circuit, adjusting a level of said filling material in said filling tank by changing a volume flow in said overflow pipe by changing a delivery rate of an overflow pump in said overflow pipe.

2. The process of claim 1, wherein using a by-pass pump comprises operating said by-pass pump at a constant delivery rate at least during normal filling operation for causing a constant volume flow in said by-pass pipe.

3. The process of claim 1, further comprising aseptically filling a container with said filling material.

4. The process of claim 1, further comprising causing said processing unit to supply a volume flow rate of filling material that is greater than a sum of a current pour rate of said container-filling machine and a by-pass volume flow rate returned by said by-pass pipe.

5. The process of claim 4, further comprising causing a volume flow rate returned by said overflow pipe to be equal to a difference between said volume flow rate supplied by said processing unit and a total of said current pour rate and said by-pass volume flow rate.

6. The process of claim 1, further comprising causing said processing unit to supply a volume flow rate that is approximately 110% of a base value, and causing said bypass flow rate to be approximately 5% of said base value, wherein said base value is a nominal pour rate of said container filling machine.

7. An apparatus comprising a filling system, wherein said filling system comprises a container-filling machine, wherein said container-filling machine comprises an annular tank, a bypass pipe, a bypass pump, a filling element, an overflow pipe, a processing unit, and a control circuit, wherein said annular tank is partially filled with said filling material and connected to said filling element, wherein said bypass pump is selected from the group consisting of a reciprocating pump, a rotary piston pump, and a diaphragm pump, wherein said bypass pipe is connected to one of said filling element and said annular tank to return a residual quantity from said annular tank to said processing unit, said residual quantity being a quantity of one of said filling material and a by-pass volume flow from said filling element, wherein said overflow pipe returns an unneeded quantity of filling material to said processing unit, said quantity of filling material that is returned back to said processing unit being a quantity that is unnecessary for filling or topping up said annular tank, wherein said processing unit is connected to said annular tank to provide said filling material to said annular tank, and wherein said control circuit is configured for controlling a delivery rate of said overflow pump in said overflow pipe so as to maintain a level of filling material in said annular tank.

8. The apparatus of claim 7, further comprising a primary pipe, wherein said primary pipe supplies said filling material to said annular tank from said processing unit, and wherein said primary pipe is free of product-damaging fittings.

9. The apparatus of claim 7, further comprising a rotating structure, wherein said filling element is disposed, along with other filling elements, around said rotating structure, and wherein said rotating structure is selected from the group consisting of a rotor and a rotating transport element.

10. The apparatus of claim 7, further comprising an overflow pump, wherein said overflow pump is disposed in said overflow pipe.

11. The apparatus of claim 10, wherein said overflow pump is a displacement pump.

12. The apparatus of claim 7, wherein said bypass pump is a displacement pump.

13. The apparatus of claim 12, wherein said bypass pump is a reciprocating pump.

14. The apparatus of claim 12, wherein said bypass pump is a rotary piston pump.

15. The apparatus of claim 12, wherein said bypass pump is a diaphragm pump.

16. The apparatus of claim 7, wherein said control circuit is configured to control said delivery rate at least in part based on a current pour rate of said filling machine.

17. The apparatus of claim 7, wherein said control circuit is configured to control said delivery rate at least in part based on an expected pour rate of said filling machine.

18. The apparatus of claim 7, wherein said control circuit is configured to control said delivery rate at least in part based on a current volume flow provided by said processing unit.

19. The apparatus of claim 7, wherein said control circuit is configured to control said delivery rate at least in part based on an expected volume flow provided by said processing unit.

* * * * *